US007857245B2

(12) United States Patent
Door et al.

(10) Patent No.: US 7,857,245 B2
(45) Date of Patent: Dec. 28, 2010

(54) APPARATUS FOR AND METHOD OF COMMINUTING AGGLOMERATES

(75) Inventors: Martin Door, Walldurn (DE); Hermann Schwinn, Hardheim (DE)

(73) Assignee: Maschinenfabrik Gustav Elrich GmbH & Co. KG, Hardheim (DE)

( * ) Notice: Subject to any disclaimer, the term of this patent is extended or adjusted under 35 U.S.C. 154(b) by 238 days.

(21) Appl. No.: 11/909,170

(22) PCT Filed: Mar. 10, 2006

(86) PCT No.: PCT/EP2006/060629

§ 371 (c)(1),
(2), (4) Date: May 15, 2008

(87) PCT Pub. No.: WO2006/100187

PCT Pub. Date: Sep. 28, 2006

(65) Prior Publication Data

US 2008/0283641 A1 Nov. 20, 2008

(30) Foreign Application Priority Data

Mar. 22, 2005 (DE) ..... 10 2005 013 716

(51) Int. Cl.
*B02C 18/16* (2006.01)

(52) U.S. Cl. ..... 241/30; 241/282.2; 241/283; 241/292.1

(58) Field of Classification Search ..... 241/223, 241/277, 282.1, 282.2, 242, 243, 292.1, 30, 241/283

See application file for complete search history.

(56) References Cited

U.S. PATENT DOCUMENTS

| | | | | |
|---|---|---|---|---|
| 3,752,410 | A | 8/1973 | Dienst et al. | |
| 3,964,732 | A | 6/1976 | Hartley | |
| 4,205,796 | A | 6/1980 | Evans | |
| 4,741,481 | A * | 5/1988 | Kalverkamp | 241/29 |
| 4,756,484 | A * | 7/1988 | Bechler et al. | 241/275 |
| 4,946,108 | A * | 8/1990 | Konig et al. | 241/78 |

FOREIGN PATENT DOCUMENTS

| | | |
|---|---|---|
| GB | 1039157 | 8/1966 |
| JP | 2002253980 | 9/2002 |

OTHER PUBLICATIONS

H. Schubert, Processing of Solid Inorganic Raw Materials, (Handbook), 4, Extensively revised edition, Leipzig, XP002378985, 1989, Germany.

* cited by examiner

*Primary Examiner*—Mark Rosenbaum
(74) *Attorney, Agent, or Firm*—Paul & Paul

(57) ABSTRACT

The present invention concerns apparatus for comminuting agglomerates and similar material to be comminuted, comprising a rotor (1) which is drivable in rotation and which has a plurality of blade-like comminuting tools (24) which can be brought into contact with the material in order to comminute same. In order to provide an apparatus for comminuting agglomerates and similar material as well as a corresponding method, which ensure a better comminuting effect and thereby and also by further measures substantially prevent material caking phenomena it is proposed in accordance with the invention that the comminuting tools comprise narrow knives (24) whose thickness measured in the axial direction of the rotor does not exceed 20 mm and whose repetition spacing in the axial direction is a maximum of 50 mm.

31 Claims, 3 Drawing Sheets

APPARATUS FOR AND METHOD OF COMMINUTING AGGLOMERATES

BACKGROUND OF THE INVENTION

The present invention concerns an apparatus for and a method of comminuting agglomerates and like material which is comminutable by mechanical blows, wherein the apparatus comprises a rotor drivable in rotation and having a plurality of blade-like comminuting tools which can be brought into contact with the material to be comminuted.

A corresponding apparatus is known for example from the prospectus 'Lockerungsschleuder' ['Loosening centrifugal separator'] from VHV Anlagenbau which is provided for comminuting agglomerates of casting sand.

When processing systems of substances which are of very fine grain size or which contain binding agent, it is possible for example at the discharge of a silo or after a mixing or granulating process for a not inconsiderable part of the flow of material to accumulate in an unwanted fashion to constitute large agglomerates or lumps. Those agglomerates are generally of a low level of compression strength and can be relatively easily comminuted to the primary grain size of the particles or granules.

Frequently, such systems of substances are fed to a downstream-disposed filling and compacting process which produces the geometrical positive or negative mould for the end product. In that respect it is important for the mould to be uniformly filled. Large agglomerates and lumps can now interfere with the flow of substance in the filling process and thus result in defects in the definitive form of the product. For that reason the agglomerates and lumps should be comminuted to such an extent that they are of the desired primary grain size or granule size.

In particular, for comminuting lumps in the preparation of moulding sand, the above-mentioned comminuting apparatus which is referred to as the 'Lockerungsschleuder' is known, which can be mounted in the form of an independent attachment on a belt conveyor.

In that case the comminuting effect is implemented by way of relatively thick flails which are protected from wear and which are fixed in a spiral form on a horizontally extending shaft, at a relatively large lateral spacing. The rapidly rotating shaft is fixed transversely with respect to the conveyor direction of the material conveyor in such a way that the rotating flails are moved through the loose material, but do not involve any contact with the subjacent belt of the belt conveyor. The inside surfaces of the cover hood which is arranged relatively closely around the centrifugal separator unit is provided for example with wear-resistant anti-adhesion linings.

The problem of the known structure is that, particularly in the preparation of moulding sand, the material disposed on the belt conveyor is loosened out of the bed of material by the relatively thick flails and flung tangentially forwardly and upwardly in the direction of rotation of the rotating shaft. The lumps are comminuted by the beating loading of the flails and upon impact against the wall of the housing. It will be noted however that, in spite of the anti-adhesion coating, in particular transport in a vertical direction at high tangential speeds leads to severe caking of material in the catch housing.

The rotating flails must therefore be moved both through the relatively loose material being conveyed and also through the compacted caked material in the housing, and that leads to a high level of wear and unnecessarily high drive power levels at the rotating shaft.

In addition, by virtue of the relatively great lateral spacing between the flails, part of the material being conveyed can pass without full contact with the rotating flails between the comminuting unit, in a non-comminuted condition.

SUMMARY OF THE INVENTION

In comparison with that state of the art the object of the present invention is to provide an apparatus for comminuting agglomerates and similar material as well as a corresponding method, which ensure a better comminuting effect and which thereby and by further measures substantially prevent material caking phenomena.

In regard to the apparatus that object is attained in that the blades comprise narrow knives whose thickness measured in the axial direction of the rotor is at a maximum 20 mm and whose repetition spacing along the axial direction is not more than 50 mm.

The above-specified repetition spacing relates in that respect to knives which are arranged approximately at the same angle with respect to the axis of the rotor, that is to say adjacent in the axial direction, and in at least partially overlapping relationship in the peripheral direction, that is to say either axially one behind the other in the same angular position or for example arranged extending in a spiral configuration around the shaft at relatively small displacement angles. It will be appreciated that otherwise a plurality of knives can also be arranged on the same axial levels that is to say with a repetition spacing of 0, at different angular positions and without mutual overlap.

It will be appreciated that the small repetition spacing in conjunction with the small thickness or size of the knives in that respect means, with a given width or axial length of the rotor, that the number of knives is substantially greater in comparison with the known apparatus, in which respect it has been found that, by virtue of the large number of relatively narrow knives, the comminuting effect can be markedly improved and in addition material caking phenomena can be better avoided or can be more easily detached again by the knife movement, which also reduces the amount of knife wear, so that the knives which are narrower (in radial plan view) are surprisingly also advantageous in regard to wear.

In that respect a preferred embodiment of the invention is one in which the thickness of the knives is less than 15 mm and in particular less than 10 mm but more than 2 mm, wherein a thickness or gauge of the knives in the range of 3 mm to 7 mm is particularly preferred.

Desirably the knives comprise a material which is as wear-resistant as possible, in particular hardened steels but also hard metal or carbide metal are also suitable for that purpose.

In the preferred embodiment the radial length of the knives is at least 25% of the rotor diameter, preferably at least 30% of the total rotor diameter.

Desirably the knives are respectively provided on rotor elements comprising a plurality of knives which are connected together and which are arranged at approximately equal angular spacings and which are connected together for example by way of a central ring, wherein that central ring can be pushed for example on to a central shaft of the rotor which is driven in rotation.

In that respect it is particularly preferred if the knives are of such a configuration that they also impart a slight lateral impulse to the material to be comminuted, besides the forwards impulse corresponding to the direction of rotation. That can be achieved for example if the individual knives which substantially comprise w ar-resistant, flat, bar-shaped elements, are either turned slightly out of a radial plane, are turned in their longitudinal direction in themselves or are angled at their free ends out of a radial plane in the axial direction. In that case those different knife configurations can also be combined together. Each of the above-mentioned features of angling or turning or twisting the knife blade has the effect that a lateral motion component is also imparted to the material which is severed by the blades. Irrespective of any profiling, each knife has a front edge, a rear edge and two oppositely disposed side faces which connect the front and rear edges together. The foregoing defined twisting or angling of the knives relates in each case to one or both of those side faces.

In that respect a particularly preferred configuration of the apparatus according to the invention is one in which the number of the knives which are angled or twisted in the one direction is approximately equal to the number of the knives which are angled or twisted in the respective opposite direction so that the motion components which are imparted to the material overall substantially cancel each other out, perpendicularly to the actual transport direction, wherein a better comminuting effect is achieved by those opposite lateral movements, in particular also by virtue of the fact that a part of the material which is severed by a knife and which is not acted upon directly by the knife is deflected somewhat in a lateral direction and is thus moved precisely into the path of movement of a knife which is adjacent or follows in the peripheral direction and in the axial direction.

In the variant with angled ends, it is preferred if the angled ends extend over less than a quarter of the radial knife length. The angling should be less than 30°, in particular less than 20°, but if possible also above 3°, for example between about 5° and 10°. Alternatively the ends could also extend curvedly, in which case the curvature is such that a tangent at the curved region at the tip of the knife differs from the radial direction by a maximum of 30°.

It will be appreciated that both knives with angled ends and simple straight flat knives can be simultaneously arranged on one and the same rotor, in which case it is generally preferred if, of the knives which have angled ends, half are angled in one direction and the other half are angled in the other direction.

In that respect it is particularly preferred if knives which are arranged at the same axial height and which are disposed in succession in the peripheral direction are respectively angled in opposite directions, in which respect sequences are also possible, in which each two knives which occur in succession in the peripheral direction are angled in the one direction and the next two knives which follow in the peripheral direction are angled in the other direction.

Desirably the individual rotor elements which have either 2, 4, 6 or 8 knives are respectively identical so that a plurality of axially successively oriented similar rotor elements form the rotor. As already mentioned the rotor elements desirably have a central ring which is pushed on to a suitable shaft, while a particularly preferred variant is one in which the ring has a radially inwardly protruding projection which is a push fit into a groove which extends axially or also slightly in a spiral or in a wave configuration along the shaft. If a corresponding projection is always arranged at the same angular position on the ring with respect to the knives, that means that the individual knives of axially successive rotor elements also follow the configuration of the groove along the shaft.

It will be appreciated that it would also be possible to provide on the shaft a radially projecting bar or the like which engages into a corresponding groove in the inside periphery of the rings of the rotor elements.

In general however it is preferred if the axially mutually aligned knives which possibly could also extend in a slightly spiral configuration or wave-like configuration instead of involving an exact axial orientation have respective identical knives, that is to say knives whose tips are respectively angled in the same direction, while a group of knives which is adjacent to the first-mentioned group in the peripheral direction could have an angling or also a twist in the other direction, in which case however at any event the knives of such a group which is oriented in the axial direction substantially in succession are respectively identical. That configuration is particularly space-saving and involves uniform gap widths between adjacent knives of the same peripheral position.

As a possible alternative or also supplemental to the angled or twisted ends of the knives, a preferred embodiment of the invention is one in which the rotor is axially movably mounted, wherein there are provided devices which impart an oscillatory axial movement to the rotor during the rotation The oscillatory axial movement is then superimposed on the rotational movement of the knives so that, during the operation of cutting through the material to be comminuted, the knives at the same time also have a motion component in the axial direction, that is to say transversely with respect to the material conveyor direction, and thus, in a similar manner to angled configurations or twists in respect of the knife tips, impart a slight lateral component with respect to the conveyor direction, to the material to be comminuted.

In the corresponding method which superimposes the axial reciprocating movement of the rotor on the rotational movement, the frequency of the oscillating movement is desirably synchronized with the rotational movement. In that respect in the preferred embodiment of the invention the axial oscillation frequency is preferably between one and four times the rotational frequency, wherein the factor between the rotational frequency and the oscillation frequency is desirably made dependent on the number of rows of knives distributed along the periphery of the rotor. In the preferred embodiment of the invention the oscillation frequency is m-times the rotational frequency, wherein m is equal to the number n of the rows of knives arranged in various angular positions, divided by two ($m=n/2$). In that case the axial reciprocating movement preferably occurs sinusoidally, wherein desirably the entire rotor including its bearings is axially reciprocatably arranged and the corresponding rotor holding assembly overall is axially reciprocated at the above-mentioned frequency.

In that respect synchronization is preferably effected in such a way that the speed of the axial oscillating movement is at its maximum precisely when a row of knives (=group of knives in substantially the same angular position with respect to the axis of the rotor) is in its deepest position in engagement with the agglomerate. When using the foregoing rule for the ratio of the oscillation frequency to the rotational frequency of the rotor the result of that is accordingly that a row of knives laterally moves the agglomerate in the one direction and the next following row of knives laterally moves the agglomerate in the other direction, in which respect it will be appreciated that the main component of the movement imparted to the agglomerate is still in or in opposite relationship to the conveyor direction because the specific (maximum) speeds of the axial oscillating movement are in practice low in relation to the peripheral speed of the knife tips.

In the preferred embodiment the amplitude of the axial oscillating movement should be no more than the axial repetition spacing of adjacent knives in the same angular position, preferably the amplitude should only be about ⅓ to ⅔ of the axial repetition spacing of the knives.

Having regard to the preferred dimensions referred to hereinbefore in respect of the axial spacing and the rotor diameter and when using a rotor having four rows of knives, that is to say for example the rotor elements shown in FIGS. 3 and 4 in the arrangement shown in FIG. 5 at the right, the details in respect of the rotational frequency, the preferred repetition spacing and the typical diameter of corresponding rotors provide that then the maximum axial speed is generally between 1/10 and 1/20 of the peripheral speed of the knife tips, in which respect it will be noted that a greater range of 1/5 to 1/50 can also be appropriately used for the ratio of those speeds to each other.

In the preferred embodiment of the invention the corresponding rotor is disposed in a housing which is of an elongate configuration transversely with respect to the axis of the rotor and which can be fitted on to a conveyor device.

In that case the housing is so designed that it closes off a space above a conveyor device, for example a conveyor belt, upwardly and laterally, wherein the side walls of the housing extend in the proximity of the edges of the conveyor belt to immediately above that conveyor belt and wherein the housing in the region of the rotor is of an internal height which is desirably between 1.5 and 3 times the rotor diameter, in particular between 1.7 and 2.3 times that height.

In that respect the length of the housing is a multiple of its height as in the preferred orientation of the rotor the material to be comminuted is thrown forwardly by the rotating knives and can be better caught at a spacing from the knives. For that purpose desirably a curtain of flexible web material is used, which hangs down at the end of the housing or shortly before the end thereof at a spacing which corresponds to a multiple and at least double the rotor diameter, and which rests on the conveyor device or the material being transported thereon. That curtain of flexible material can in particular also comprise a plurality of parallel strips and it is also possible for two or more such curtains also to be arranged at a short spacing one behind the other in order to ensure that no material at all is ejected forwardly out of the housing at high speed.

The top side of the housing is desirably also lined with a flexible and preferably wear-resistant web material, wherein it will be noted that the term lining is not used here to denote a close contact or even a coating on the inside wall of the housing, but rather that flexible web material hangs down loosely from the top side of the housing or is suspended loosely at a spacing below the upper inside wall of the housing.

It has been found that such a material web which hangs down loosely prevents material caking phenomena substantially better than any anti-adhesion coating or fixed lining on the inside wall of the housing. That is particularly because any adhering material repeatedly flakes off by virtue of movements which the flexible web material experiences solely by virtue of particles of material striking there against. That can possibly also be promoted by specific active movement of the flexible material web. In this case also that web which hangs down loosely can again consist of a plurality of parallel strips which are even more mobile and more flexible than all continuous webs in respect of the full width thereof. It will be appreciated that wear-resistant materials with the lowest possible adhesion capability for material caking thereon are also preferred for the flexible web.

The method according to the invention is characterised in that a rotor having the aforementioned features is used, wherein in a preferred embodiment the rotor is so arranged that, upon engagement into the material being transported under the rotor, the knives are moved through that material in the conveyor direction. In particular that relative movement of the knives which pass through the material, with simultaneous transport of the material along a conveyor direction, is also what effectively imparts a lateral motion component to the material when angled knife tips are involved.

In accordance with the invention the apparatus in question is fitted on to a conveyor device, in which respect it is to be noted that the knives engage into the material being transported on a conveyor belt or a similar web, but in that respect at any event they maintain a safety distance relative to the conveyor belt itself in order not to damage it.

The peripheral speeds at the outer ends of the knives are desirably between 5 and 20 m/s preferably between 10 and 15 m/s in that respect the conveyor speed is of the order of magnitude of 0.5 to 2 m/s, in particular about 1 m/s. With a differing conveyor speed the rotary speed of the rotor can also be correspondingly adapted so that overall that affords the above-mentioned relative speeds which however are also material-dependent and in that respect can differ from the foregoing values.

Desirably the material is moved by the knives not only in the direction of rotation of the knives but also perpendicularly thereto with a reciprocating movement, while the knives cut through the material. That is effected in particular by using knives of a suitable shape.

BRIEF DESCRIPTION OF THE DRAWINGS

Further advantages, features and possible uses of the present invention will be clearly apparent from the description hereinafter of a preferred embodiment and the associated Figures in which.

DETAILED DESCRIPTION OF THE INVENTION

Figure 1:
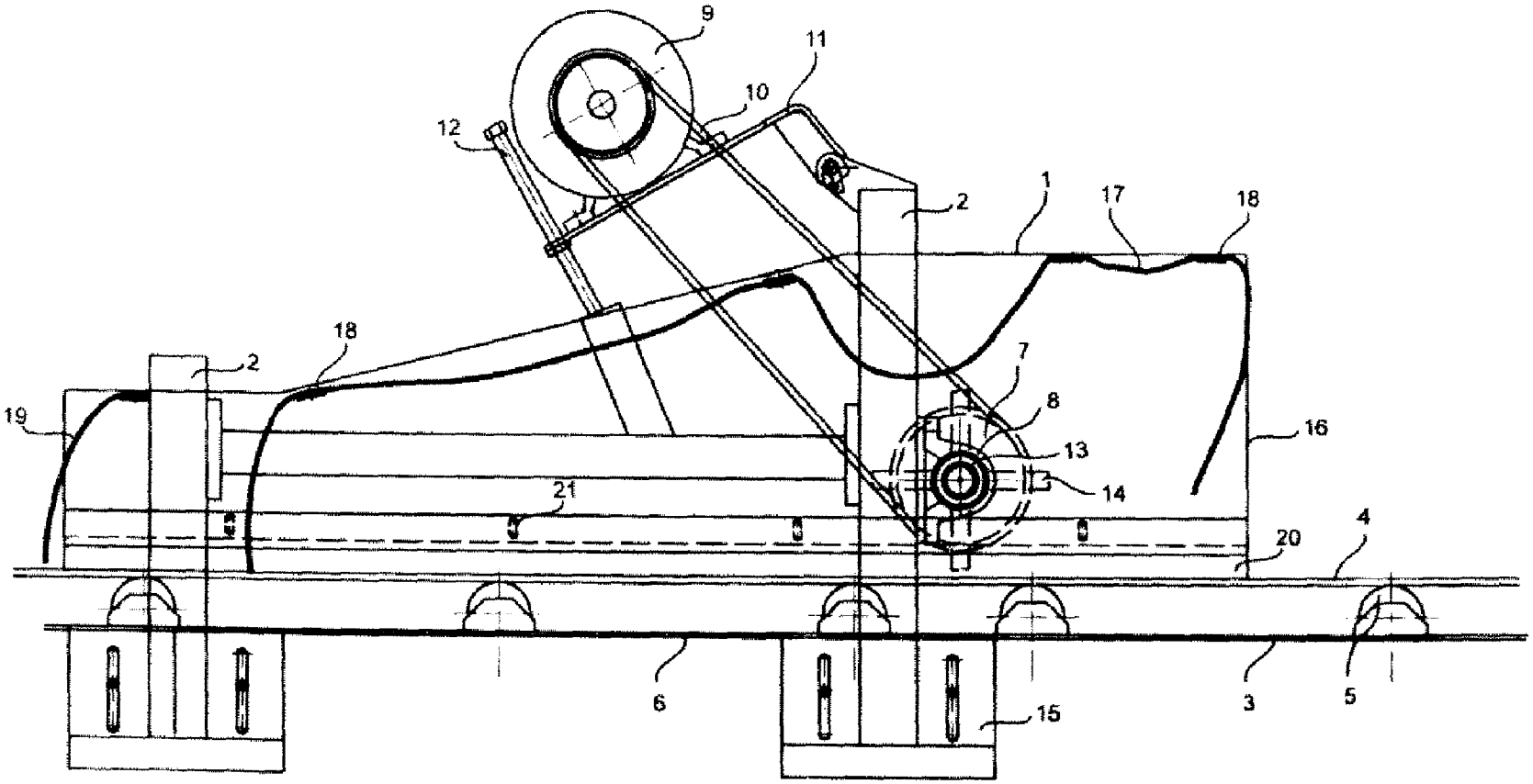
FIG. 1 shows a side view of a comminuting apparatus which is mounted on a belt conveyor and in a housing.
Figure 2:
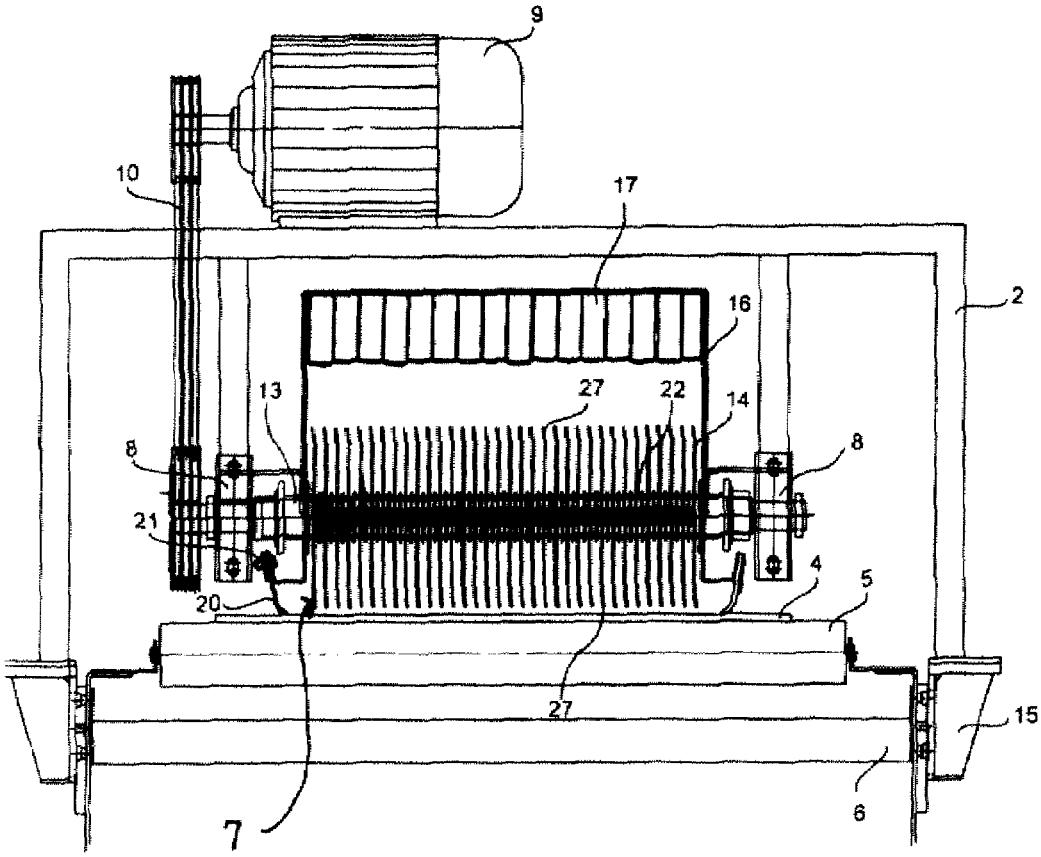
FIG. 2 shows a front view of the comminuting apparatus of FIG. 1.

The comminuting apparatus according to the invention is shown in FIG. 1 as a side view and in FIG. 2 as a front view. The comminuting apparatus substantially comprises a rotor 7 and is fixed by means of a carrier frame 2 on a material conveyor 3. The material being conveyed such as for example casting mould sand is disposed on a belt 4 which runs flat and which is supported by way of carrier rollers 5 on the frame of the belt conveyor 6. The rotor 7 or the shaft 13 thereof is held laterally in bearings 8 which are fixed to the carrier frame 2. The rotor 7 is driven by way of a motor 9 with a V-belt transmission 10. The motor 9 is fixed on a motor rocker arm 11 so that the V-belt transmission 10 can be tensioned by way of a pressure screw 12. Fixed on the central shaft 13 of the rotor 7 are rotor elements 14 which have knife-like comminuting means, referred to for brevity as 'knives 24', with angled ends 27. A gap can be set by way of a holding device 15 which is appropriately adjustable in respect of height, between the outer ends of the comminuting means and the belt 4. The cover housing 16 of the comminuting apparatus is held in position between the carrier frame 2. In order to prevent sand from issuing in the direction of rotation of the rotor 7 the cover housing 16 is of a long configuration in the direction of rotation of the rotor 7 and downstream of the rotor is for example still of a length which is about 4-6 times the rotor diameter.

The internal space of the cover housing 16 is provided with a curtain of flexible material 17, such as for example rubber. In the preferred embodiment that curtain is made from strips of the flexible material, which are arranged in parallel relationship and which are hung down in the longitudinal or transverse direction from the cover housing 16, that is to say from the side walls or from the upper wall. The curtain 17 is fixed to the cover housing 16 for example by way of clamping bars 18. At the end of the cover housing in the direction of rotation of the rotor (meant here as the direction of movement of the knives 24 in the respective lower portions which are in engagement with the agglomerate) the curtain is hung down in such a way that it rests in rubbing contact on the belt or the material being conveyed and thus prevents an unwanted discharge of product which is flung up in small amounts by the rapidly rotating rotor 7, in the direction of conveying movement of the conveyor belt. In order quite reliably to prevent discharge of product, two or more curtains 19 of flexible material can be disposed in succession.

Rotation of the rotor 7 preferably takes place in a direction which in the lower region of engagement of the rotor is the same as the transport direction of the belt 4 of the belt conveyor 3. It will be appreciated that operation in the opposite direction is equally possible, even if not preferred at the present time.

The shape of the housing in the preferred embodiment is of a wedge-shaped tapering configuration in the direction of the discharge opening of the belt 4, wherein the height above the belt 4 in the region of the rotor is between 1.5 and 3 times the rotor diameter D, preferably between 1.7 and 2.3 times the diameter D. In the discharge region at the curtain 19 the height above the belt 4 is between 0.5 and 1.5 times the diameter D of the rotor 7, preferably between 0.7 and 1.3 times the diameter D).

Lateral sealing of the comminuting apparatus 1 on the belt 4 is effected by rubber lips 20 which are fixed to the housing 16 in rubbing contact against the belt 4. Adjustment of the sealing gap is effected when using rubber lips for example by way of screw arrangements by means of clamping bars 21 provided with slots.

The rotor 7 comprises a plurality of rotor elements 14 which are arranged in a row configuration in mutually juxtaposed relationship on the central shaft 13. The rotor elements 14 can be connected exchangeably or also non-exchangeably to the central shaft 13. In addition the complete rotor 4 can be made from one piece. In the preferred embodiment the rotor elements 14 are releasably connected to the central shaft 13 and have rotor blades or knives 24 which are respectively displaced through 45°, 60°, 90° or 180° relative to each other. The spacing necessary between the knives 24 or between the rotor elements 14 is adjusted by way of spacers 22 disposed therebetween. Besides the above-indicated angular arrangements of the knives 24 any other angular settings are also possible. The angled ends 27 of the knives 24, which ends are arranged in axially immediately mutually juxtaposed relationship at the same angular position, each face in that case in the same direction, while the ends 27 of the knives 24 arranged in a fixed angular position which is different (with respect to the axis of the shaft 13) are jointly angled in the opposite direction.

Figure 3:
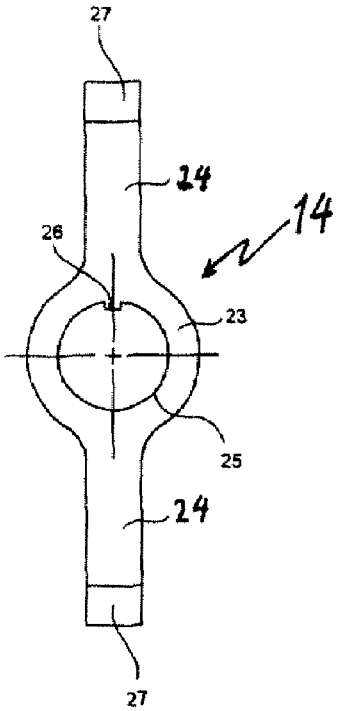
FIG. 3 shows a plan view of a rotor element.
Figure 4:
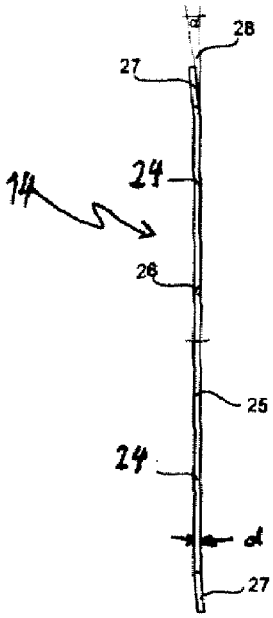
FIG. 4 shows a side view of a rotor element, and FIG. 5 diagrammatically shows a side view of a variant with a plurality of rotors or rotor elements mounted in succession and above a belt.

FIG. 3 shows a preferred variant of the rotor element 14 in an (axial) plan view. FIG. 4 shows the associated radial side view. A strip which for example is cut out of a sheet or plate with a central ring 23 and which forms a rotor element 14 has two knife-like arms which are arranged in opposite directions, referred to hereinafter for brevity as knives 24. A nose 26 is formed at the inner edge 25 of the ring-shaped cut-out portion 23, the nose 26 by way of a corresponding groove on the central shaft permitting non-rotational fitment thereof.

The ends 27 of the knives 24 are angled in opposite directions out of the plane through an angle $\alpha$. The angle $\alpha$ is between 3° and 20°, preferably between 5° and 10°.

Figure 5:
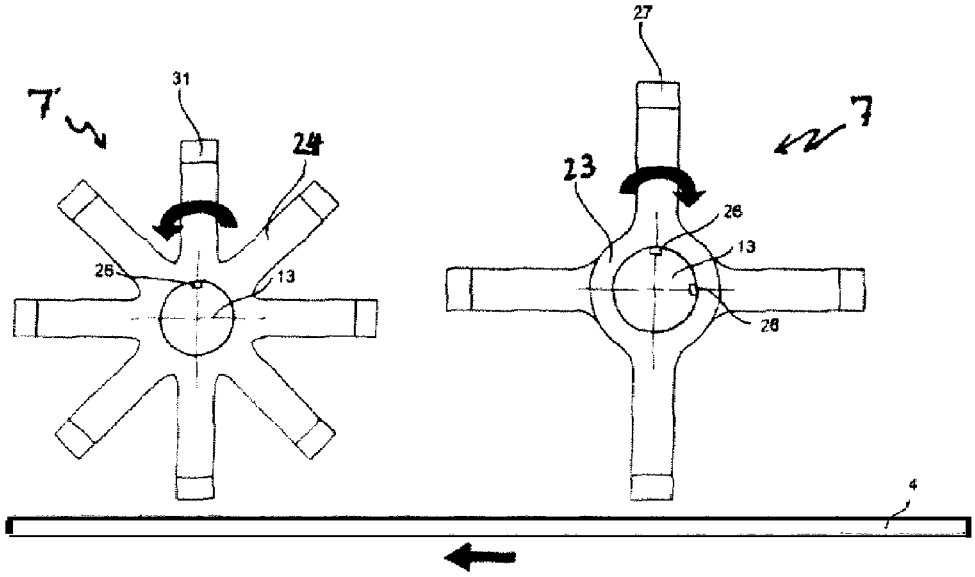

The rotor shown in FIG. 2 is made up of the rotor elements 14 as are shown in FIGS. 3 and 4. In that respect, two axially immediately successive rotor elements 14 are respectively turned through 90° relative to each other so that in the axial plan view the rotor configuration is as is to be seen in relation to the rotor which is shown at the right in FIG. 5. In that respect the four rotor arms or knives 24, as is also shown at the right in FIG. 5, are arranged on two axially successively arranged rotor element rings 23, wherein there are always two knives 24 which are provided in pairs in mutually opposite relationship in one piece with such a ring 23 and the rings in question are respectively turned through 90° relative to each other, as can also be seen by reference to the noses 26 which engage into two corresponding grooves, extending in parallel relationship with the axis, of a central shaft 13. In that way all rotor elements 14 can be identically produced in the configuration shown in FIGS. 3 and 4, wherein the four individual knives 24 which are respectively arranged in succession at four different angular positions in two different axial positions are respectively angled at two successive positions in one direction and in the next two successive positions in the other direction. It would however equally be possible for the angling of the knife tips 27 at each of the rotor elements 14 to be respectively implemented in the same direction and then for the rotor elements 14 which are respectively turned through 90° relative to each other and which occur in immediate axial succession to be also turned about their longitudinal axis relative to each other so that the angling direction of the knife tips changes in the peripheral direction after each 90°, for two immediately adjacently arranged rotor elements.

It will be appreciated that, in the above-described embodiment in which the rotor elements 14 each have two knives 24 as shown in FIGS. 3 and 4, wherein each two successive rotor elements, as can be seen at the right in FIG. 5, are turned relative to each other through 90° about the axis or the shaft 13 of the rotor 7, the repetition spacing of the knives 24 which are adjacent in a row is double the repetition spacing of the rotor elements 14.

In the case of such an embodiment or when considering other rotors which are made up of two-bladed rotor elements 14 it is possible to entirely dispense with additional spacers between the rotor elements.

In further variants (not shown), and independently of the one-piece configuration with (or without) the central ring 23, besides the angled shape of the ends, ends which are slightly turned out of the plane of the sheet metal strip (plane of the paper in FIG. 3), that is to say knives 24 which are twisted in themselves, are also possible. The blade-like knives however can also be totally turned out of the plane of the paper in FIG. 3 through a certain (fixed) angle. In that respect, in both the above-mentioned cases, the twist angle should not exceed a maximum value of 30°, preferably 10°. In the case of knives which are twisted in themselves, it is moreover appropriate if the twist angle is at a maximum at the end of the knife that is closer to the axis and at a minimum at the knife tip as the peripheral speed of the knife tip is greater and therewith also the pulse transmission in the axial direction, with the same twist angle, is greater at the knife tip than at the portions which are closer towards the axis. It will be noted however that in most practical cases the twist angle of the knives in a portion of the knives 24 which is close to the shaft 13 or the axis will not be an important consideration as the knives predominantly come into engagement with the agglomerate, only with their radially outer portions.

The thickness of the knife in the region of engagement into the material being conveyed is generally between 2 mm and 10 mm, preferably between 3 mm and 5 mm. The spacings between the arms 24 and the ends 2 of the comminuting means are between 3 mm and 15 mm, preferably between 3 mm and 7 mm, thus affording a repetition spacing of the rotor elements 14 in the axial direction of a minimum of about 5 to (preferably) a maximum of 25 mm, in which respect repetition spacings of up to 50 mm also appear entirely appropriate. The total diameter D of the rotor 4 is between 150 mm and 400 mm, preferably between 250 mm and 300 mm. The axial length of the rotor 7 is adapted to the width of the belt conveyor and is between 80% and 100% of the total width, preferably between 90% and 95% of the total width of the conveyor belt 4.

The peripheral speed at the outer ends 27 of the rotor elements 14 is between 5 m/s and 20 m/s, preferably between 10 m/s and 15 m/s. The decisive consideration for efficient operation is the relative speed with respect to the belt conveyor which, with a conveyor speed of 1 m/s, depending on the respective direction of rotation of the rotor, is between 4 m/s and 21 m/s, preferably between 9 m/s and 16 m/s.

A further variant of a comminuting, apparatus is shown in FIG. 5. Besides the use of an individual rotor, the arrangement of two or more successively connected rotors 7, 7' is accordingly also possible. The direction of rotation of the rotors 7, 7' can be in one direction but also in different directions. The peripheral speeds of the rotors can be of the same magnitude or different. In addition, besides the use of rotors which are of a similar structure and of the same size, it is also possible to use rotors which are of different diameters. The shape and the axial spacing of the rotor elements on the different rotors can also differ.

The invention claimed is:

1. Apparatus for comminuting agglomerates material to be comminuted, comprising a rotor (1) which is drivable in rotation and which has a plurality of blade-like comminuting tools (24) which can be brought into contact with the material in order to comminute same, characterised in that the comminuting tools comprise narrow knives (24) whose thickness measured in the axial direction of the rotor is at least 3 mm and does not exceed 20 mm and whose repetition spacing in the axial direction is less than 30 mm, the overall rotor diameter being from between 150 and 400 mm and the radial length of the individual knives being at least 25% of the overall rotor diameter.

2. Apparatus according to claim 1 characterised in that the thickness of the knives measured in the axial direction of the rotor is at least 3 mm and at most 7 mm and that the radial length of the individual knives is at least 30% of the overall rotor diameter.

3. Apparatus according to one of claims 1 to 2 characterised in that the repetition spacing is less than 20 mm and at least 5 mm.

4. Apparatus according to one of claims 1 to 2 characterised in that the repetition spacing is less than 20 mm and at least 8 mm and that the rotor comprises a plurality of axially successively arranged rotor elements which respectively have a plurality of knives distributed at equal angular spacings.

5. Apparatus according to claim 4 characterised in that the plurality rotor elements arranged at equal angular spacings relative to each other each have their plurality of knives selected from the group of 2, 4, 6 and 8 knives.

6. Apparatus according to claim 5 in which a plurality of rotor elements are arranged in an axial succession characterised in that the ends of the successive rotors are angled in the same direction and are arranged approximately in the same angular position.

7. Apparatus according to one of claims 1 to 2 characterised in that the knives (24) which extend in the radial direction of the rotor are twisted in themselves from the centre outwardly.

8. Apparatus according to claim 7 characterised in that the number of knives twisted in a first direction is approximately equal to the number of knives twisted in a second direction.

9. Apparatus according to one of claims 1 to 2 characterised in that each knife has a free end and that the free ends of the knives are angled out of a radial plane in the axial direction wherein sequences of knives alternate in angled axial direction.

10. Apparatus according to claim 9 characterised in that the angled ends constitute less than a quarter of the radial knife length.

11. Apparatus according to claim 9, characterised in that the ends of the knives (24) are angled through an angle $\alpha$ which is less than 30°, but at least 3°.

12. Apparatus according to one of claims 1 to 2 characterised in that the knives (24) are angled through an angle $\alpha$ which is less than 20°, but at least 5° and that the ends of the knives are curved out of a radial plane in the axial direction, wherein the tangent at the knife tip includes an angle of less than 30° with the radial direction.

13. Apparatus according to claim 9 characterised in that the knives (24) are angled through an angle $\alpha$ of at least 10° and that of the totality of the knives of a rotor approximately half the knife ends are angled in the one axial direction and the other knives are angled in the opposite axial direction.

14. Apparatus according to one of claims 1 to 2 characterised in that the rotor is arranged in a housing which is of an elongate configuration transversely with respect to the rotor axis and which can be fitted onto a conveyor device.

15. Apparatus according to claim 14 characterised in that on its inside the housing is provided with a flexible web material which hangs down loosely from the upper inside wall of the housing and is positioned to catch material thrown by the knives.

16. Apparatus according to claim 15 characterised in that the web material comprises a plurality of parallel strips.

17. Apparatus according to claim 15 characterised in that the flexible web material is wear-resistant.

18. Apparatus according to claim 15 characterised in that the web material, in the conveyor direction, forms a curtain which hangs down onto the non-comminuted material being transported.

19. Apparatus for comminuting agglomerates material to be comminuted, comprising a rotor (1) which is drivable in rotation and which has a plurality of blade-like comminuting tools (24) which can be brought into contact with the material in order to comminute same, characterised in that the comminuting tools comprise narrow knives (24) whose thickness measured in the axial direction of the rotor does not exceed 20 mm and whose repetition spacing in the axial direction is a maximum of 50 mm, characterized in that the rotor is axially movably mounted, wherein there are provided devices for axial reciprocating movement of the rotor during the rotation of the rotor about its axis.

20. Apparatus according to claim 5 characterised in that there are provided synchronizing devices for synchronizing the axial reciprocating movement with the rotary movement of the rotor.

21. A method of comminuting agglomerates material which is comminutable by mechanical blows, wherein an apparatus is employed having a rotor for contacting the material and which rotor carries blade-like comminuting tools used for comminuting the material by mechanical blows, characterised by the steps of using the rotor to contact the material, and comminuting the material with knives which are of a thickness of at least 3 mm and at most 7 mm measured in the axial direction of the rotor and an axial repetition spacing of less than 30 mm, the overall rotor diameter being from between 150 and 400 mm, and the length of the individual knives being at least 25% of the overall rotor diameter.

22. A method according to claim 21 further characterised by angling a portion of the knives in a first peripheral direction for imparting a motion to the material in that first peripheral direction and angling the remainder of the knives in an opposite peripheral direction for imparting a motion to the material in that opposite peripheral direction.

23. A method according to one of claims 20 to 21 further characterised by fitting the apparatus onto a conveyor device transporting the material, and selecting the direction of rotation of the rotor so that the knives are cutting through the material which is transported on the conveyor device in the direction of conveyor transport.

24. A method according to one of claims 20 to 21 further characterised by catching material, which is flung up by the rotor, with a flexible web material which hangs down loosely from the upper inside wall of the housing of the apparatus.

25. A method according to one of claims 21 to 22 further characterised by axially reciprocating the rotor (1) during its rotary movement.

26. A method according to claim 25 further characterised by providing that the maximum axial speed of the rotor is less than ½ of the peripheral speed of the rotor.

27. A method according to claim 25 further characterised by providing that the maximum axial speed of the rotor to be less than 1/10 of the peripheral speed of the rotor and the frequency of the reciprocating movement is an integral multiple of the frequency of the rotary movement of the rotor, wherein the integral multiple preferably corresponds to the number of knife rows arranged in different angular positions divided by two.

28. A method according to claim 25 further characterised by providing that the amplitude of the axial reciprocating movement of the rotor is less than or equal to the knife spacing and between ⅓ and ⅔ of the axial knife spacing between adjacent knives of the same angular position.

29. A method according to claim 25 further characterised by providing that the rotational frequency of the rotor and the axial reciprocating frequency of the rotor are synchronized together in such a way that the rotor knives always have a maximum axial speed when the tips of an axially oriented knife row reach their deepest point.

30. A method according to claim 29 further characterised by providing that the knives are twisted in themselves and are angled at their ends in order to deflect the material when cutting therethrough in part in the axial direction of the rotor.

31. A method according to claim 30 further characterised by providing that the number of knives which are twisted in one direction and angled at their tip in one direction approximately corresponds to the number of knives which are twisted in the opposite direction or angled in the opposite direction.

* * * * *

UNITED STATES PATENT AND TRADEMARK OFFICE

CERTIFICATE OF CORRECTION

PATENT NO. : 7,857,245 B2
APPLICATION NO. : 11/909170
DATED : December 28, 2010
INVENTOR(S) : Martin Dorr and Hermann Schwinn It is certified that error appears in the above-identified patent and that said Letters Patent is hereby corrected as shown below:

Cover page under item (12) "Door" should read -- Dorr --

Cover page item (75) reads "Inventors: Martin Door, Walldurn (DE); Hermann
should read -- Inventors: Martin Dorr, Walldurn (DE); Hermann --

Column 2, line 64, reads "which substantially comprise w ar-resistant, flat, bar-shaped"
should read -- which substantially comprise wear-resistant, flat, bar-shaped --

Column 6, lines 7-10, reads "The peripheral speeds at the outer ends of the knives are desirably between 5 and 20 m/s preferably between 10 and 15 m/s in that respect the conveyor speed is of the order of magnitude of 0.5 to 2 m/s, in particular about 1 m/s. With a"

should read -- The peripheral speeds at the outer ends of the knives are desirably between 5 and 20 m/s preferably between 10 and 15 m/s. In that respect the conveyor speed is of the order of magnitude of 0.5 to 2 m/s, in particular about 1 m/s. With a --

Column 7, lines 30-31, reads "of the rotor 7, preferably between 0.7 and 1.3 times the diameter D).

should read -- of the rotor 7, preferably between 0.7 and 1.3 times the diameter D. --

Signed and Sealed this
Twenty-second Day of February, 2011

David J. Kappos

David J. Kappos
*Director of the United States Patent and Trademark Office*